US011400459B2

(12) United States Patent
Andreaco et al.

(10) Patent No.: US 11,400,459 B2
(45) Date of Patent: Aug. 2, 2022

(54) DEVICE FOR SEPARATING MATERIALS

(71) Applicant: Siemens Medical Solutions USA, Inc., Malvern, PA (US)

(72) Inventors: Mark S. Andreaco, Knoxville, TN (US); George K. Schweitzer, Knoxville, TN (US); Jake A. Stewart, Knoxville, TN (US); Brant Quinton, Knoxville, TN (US); Troy Marlar, Knoxville, TN (US)

(73) Assignee: Siemens Medical Solutions USA, Inc., Malvern, PA (US)

( * ) Notice: Subject to any disclaimer, the term of this patent is extended or adjusted under 35 U.S.C. 154(b) by 209 days.

(21) Appl. No.: 16/837,372

(22) Filed: Apr. 1, 2020

(65) Prior Publication Data

US 2020/0230610 A1 Jul. 23, 2020

Related U.S. Application Data

(62) Division of application No. 14/525,238, filed on Oct. 28, 2014, now Pat. No. 10,646,882.

(60) Provisional application No. 61/897,467, filed on Oct. 30, 2013.

(51) Int. Cl.

| | |
|---|---|
| ***B03B 5/62*** | (2006.01) |
| ***B02C 23/18*** | (2006.01) |
| *B03B 5/00* | (2006.01) |
| *B03B 5/60* | (2006.01) |

(52) U.S. Cl.
CPC ..... *B03B 5/62* (2013.01); *B02C 23/18* (2013.01); *B03B 5/00* (2013.01); *B03B 5/60* (2013.01)

(58) Field of Classification Search
CPC .... B03B 5/00; B03B 5/60; B03B 5/62; B02C 23/18
See application file for complete search history.

(56) References Cited

U.S. PATENT DOCUMENTS

| | | | |
|---|---|---|---|
| 4,059,506 | A | 11/1977 | Bryson |
| 4,715,949 | A | 12/1987 | Watts |
| 4,818,375 | A | 4/1989 | Dorph |
| 5,104,047 | A | 4/1992 | Simmons |
| 5,429,311 | A | 7/1995 | Cina et al. |
| 5,894,996 | A | 4/1999 | Williams |
| 6,213,306 | B1 | 4/2001 | Fiedlschuster et al. |
| 2013/0200004 | A1 | 8/2013 | Galvin |

*Primary Examiner* — Michael McCullough
*Assistant Examiner* — Kalyanavenkateshware Kumar

(57) ABSTRACT

Disclosed herein is a method comprising discharging a slurry from a vessel to a conduit; where the slurry comprises a liquid and a composition comprising at least two materials having different densities-a first material having a higher density and a second material having a lower density than that of the first material; creating a surge in velocity in slurry flow as it is transported through the conduit; separating the first material from the second material; where the first material is disposed on an inner surface of the conduit and where the second material flows through the conduit to a container; and removing the first material from the inner surface of the conduit.

5 Claims, 1 Drawing Sheet

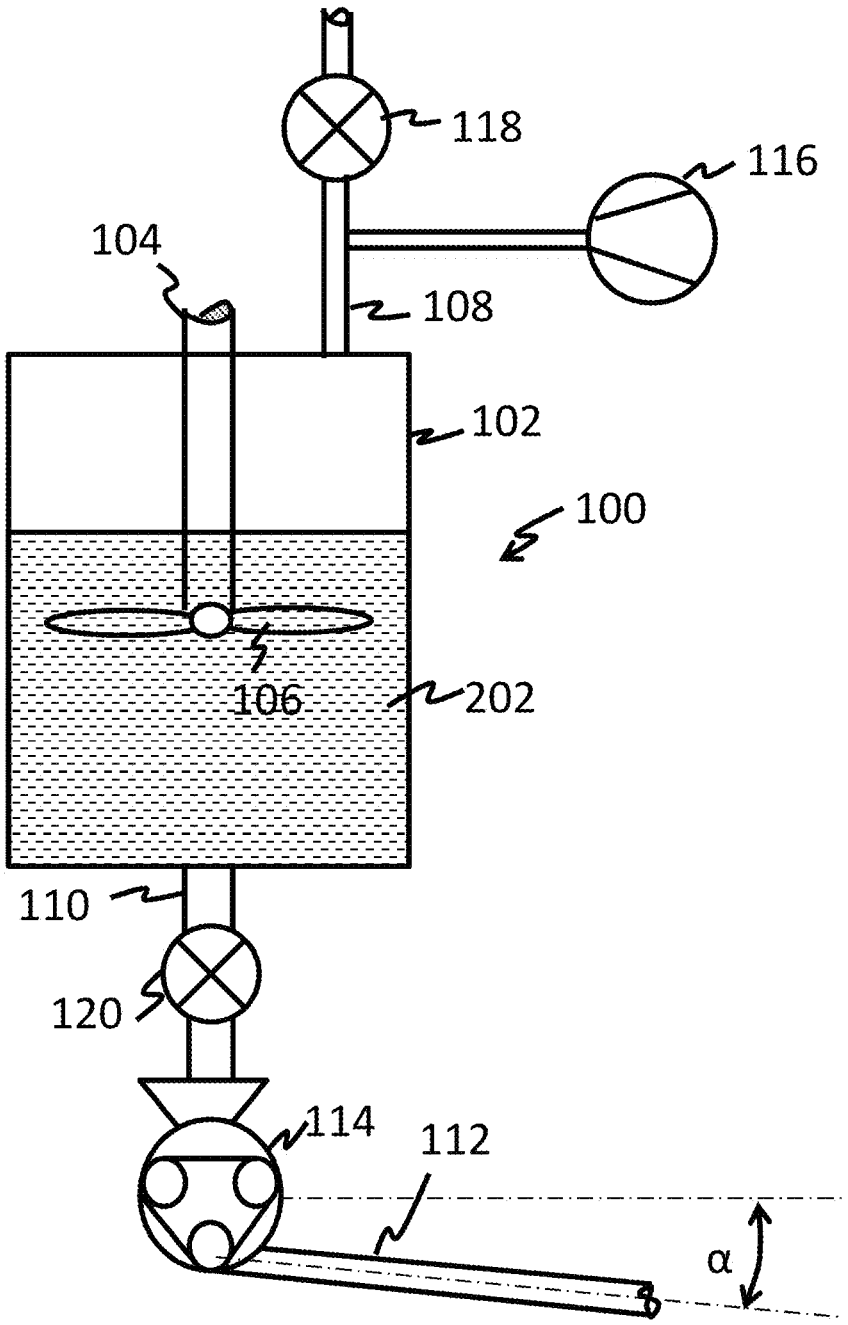
118
116
104
108
102
100
106
202
110
120
114
112
α

DEVICE FOR SEPARATING MATERIALS

RELATED APPLICATIONS

This disclosure is a divisional of U.S. application Ser. No. 14/525,238, filed Oct. 28, 2014, which claims priority to U.S. Provisional Patent Application No. 61/897,467 filed on Oct. 30, 2013, the entire contents of which are hereby incorporated by reference.

BACKGROUND

This disclosure relates to a device for separating materials and to a method for accomplishing the same. In particular this disclosure relates to a device for separating materials that have slightly different densities from each other and to a method for accomplishing the same.

Iridium is a platinum group metal that displays very good corrosion resistance, which renders it useful for growing crystals. The ability of iridium to remain pure (resist corrosion or reaction) makes it suitable for use as a crucible in growing crystals of lutetium oxyorthosilicate ($Lu_2OSiO_4$).

During the crystal growth process, the iridium crucible may reach temperatures greater than 2000° C. During the crystal growth process, iridium is deposited from the crucible onto the zirconium dioxide insulation of the furnace that is used for the crystal growth. It is desirable to recover the iridium deposited on the zirconium dioxide due to its current value of approximately $1050 per troy ounce.

SUMMARY

Disclosed herein is a method comprising charging a slurry to a conduit; where the slurry comprises a liquid and a composition comprising at least two materials having different densities, a first material having a higher density and a second material having a lower density than that of the first material; creating a surge in velocity in slurry flow as it is transported through the conduit; separating the first material from the second material; where the first material is disposed on an inner surface of the conduit and where the second material flows through the conduit to a container; and removing the first material from the inner surface of the conduit.

Disclosed herein is a device comprising a vessel having an inlet port and an outlet port; where the vessel is provided with an agitator that is operative to agitate a content of the vessel; at least one of a compressor and a pump that is in fluid communication with the vessel through a valve; where the compressor is in fluid communication with the inlet port; where the compressor lies upstream of the vessel; where the pump is in fluid communication with the outlet port; where either the pump, the compressor and the valve, or the pump and the valve are operative to produce a surge in a flow of a slurry discharged from the vessel; and a conduit in fluid communication with the outlet port; where the conduit contacts the pump outlet and has a steady incline of 3 degrees to 45 degrees from the pump outlet with respect to a horizontal.

BRIEF DESCRIPTION OF THE FIGURES

FIG. 1 is a depiction of an exemplary device used for slurrying the particles and for facilitating the separate collection of the particles.

DETAILED DESCRIPTION

Disclosed herein is a method of collecting separately the individual ingredients of a composition that comprises two or more materials and that may optionally be bonded together. It is desirable for the two materials to have a difference in density between them. This difference in density may be minimal. In particular, disclosed herein is a method for separating iridium from zirconium dioxide, when the two are bonded to each other. The method comprises optionally grinding the composition comprising two or more materials to form particles, optionally thermally treating the materials to debond the two or more materials from one another, optionally fractionating particles of different sizes into different groups, dispersing the particles of a particular particle size group in a liquid, and collecting the separated materials as they are charged into a conduit while promoting surges in velocity in the liquid travelling through the conduit during the discharge.

The composition may comprise two or more materials that are bonded together (e.g., iridium that is bonded to zirconium dioxide as detailed above) or alternatively that are mixed together but not bonded together. If the materials are bonded together they are subjected to grinding and to an optional thermal treatment in order to facilitate debonding. After debonding, they may be separated by dispersing the particles in a liquid, for example, a liquid contained in a vessel, and collecting the separated materials as they are charged to the conduit, for example, discharged from the vessel into the conduit If they are not bonded together but instead are just mixed together, they may be separated by only dispersing the particles in a liquid, for example, a liquid contained in a vessel, and collecting the separated materials as they are charged to a conduit, for example, discharged from the vessel into a conduit. In short, compositions comprising two or more materials that are not bonded together may be separated and collected without undergoing grinding or thermal treatment.

While the method outlined above is largely directed to the separation of iridium from zirconium oxide, it may be used to separate other combinations of metals, non-metallic derivatives (i.e., derivatives of metals that are non-metallic) and/or polymers from one another. The method may also be used, for example, to separate a first metal from a second metal, a first metal from a first non-metallic derivative, a first metal from a polymer, a first non-metallic derivative from a second non-metallic derivative, a first non-metallic derivative from a first polymer, or a first polymer from a second polymer. In an embodiment, the method may be used to separate one material from a plurality of other materials, such as for example, separating a first metal (e.g., iridium) from a plurality of different non-metallic derivatives (e.g., a mixture of zirconium dioxide and silicon dioxide). It is to be noted that the terms first and second are used to imply that two elements labelled "first" and "second" are different from each other.

Examples of metals are iridium, platinum, rhodium, palladium, gold, silver, titanium, iron, cobalt, copper, aluminum, or the like, or a combination thereof. An exemplary metal is iridium.

The non-metallic derivatives are metal oxides, metal carbides, metal oxycarbides, metal nitrides, metal oxynitrides, metal borides, metal borocarbides, metal boronitrides, metal silicides, metal iodides, metal bromides, metal sulfides, metal selenides, metal tellurides, metal fluorides or metal borosilicides. An exemplary non-metallic derivative is a metal oxide. Examples of metal oxides are silicon dioxide, aluminum oxide, titanium dioxide, zirconium dioxide, cerium oxide, or the like, or a combination thereof. An exemplary metal oxide is zirconium dioxide. In an exemplary embodiment, the method may be used to separate a first metal from a first metal oxide. In another exemplary embodiment, the method may be used to separate iridium from zirconium dioxide.

The composition comprising two or more materials is subjected to grinding if the materials are bonded together. If the materials are not bonded together, the grinding of these materials may be omitted. Grinding is conducted to reduce the particle size of the materials and also to facilitate a debonding of the materials from one another when they are bonded together prior to the grinding. The term "debonding" as used herein means that the bonded materials are separated from each other but are still mixed together. In order to separately collect each of the debonded materials, the composition is subjected to further steps that are detailed below.

The grinding of the composition may be conducted in a mill. Examples of mills are ring mills, ball mills, rod mills, autogenous mills, semi-autogenous grinding (SAG) mills, pebble mills, high pressure grinding rolls, Buhrstone mills, vertical shaft impactor (VSI) mills, beater wheel mills, hammer mills, tower mills, or the like, or a combination thereof. In an exemplary embodiment, the grinding is conducted in a ring mill.

In the case of a composition comprising iridium and zirconium oxide, grinding in a ring mill is conducted to reduce particle size to 100 to 250 micrometers. The grinding of the composition to particles in this size range facilitates the debonding of the iridium from zirconium oxide. If the particle sizes are larger than 250 micrometers, then the iridium does not completely debond from the zirconium oxide. On the other hand, particle sizes of less than 100 micrometers prevent the particles from being easily separated. In particular, particle sizes of less than 100 micrometers prevent the particles from settling rapidly when added to a liquid during the process to collect the separated particles. While the grinding debonds the two bonded materials from each other it does not separate them from the composition they are in. Separating them from each other uses additional steps that are detailed below.

In addition to the grinding, or alternatively, in lieu of the grinding, it may be desirable to optionally heat the (optionally ground) materials that are still bonded to each other and then immerse them in a cold fluid to facilitate the debonding. Materials that do not debond upon grinding but that have different thermal coefficients of expansion may be subjected to this form of thermal treatment to facilitate debonding.

The debonded materials are then optionally fractionated in order to separate different particle sizes into different groups based on their sizes. Effective separation of the particles from one another is achieved by fractionating the particles (of the different materials in the composition) into groups of particles of different sizes, where each group has a narrow polydispersity index. By using a narrow polydispersity index, angular momentum variations during agitation in the vessel (when the particles are slurried) are minimized. This facilitates an easier and more effective particle separation during the flow through the conduit and will be discussed in detail later. Polydispersity measurements are based upon the sum of the particle weights divided by the total number of particles. For a particular group of particles, the polydispersity index is 1.0 to 1.20, specifically 1.0 to 1.18 and more specifically 1.0 to 1.05. In an embodiment, in a particular group at least 20%, specifically at least 50%, and more specifically at least 80% of the particles are monodisperse (i.e., have a polydispersity index of 1.0). The fractionating of particles into groups of different sizes having a narrow polydispersity index may accomplished by using sieves. Sieves having different size meshes may be used to accomplish the fractionation.

Each group of optionally fractionated particles is then introduced separately into a vessel in which the particles are slurried in a liquid and discharged into a conduit to effect separation. FIG. 1 is a depiction of an exemplary device 100 used for slurrying the particles and for facilitating the separate collection of the particles. The device comprises a vessel 102 (e.g., a reactor) having an inlet port 108 and an outlet port 110. The inlet port is fitted with a valve 118 and an optional compressor 116. The outlet port 110 is fitted with a valve 120 and a pump 114 that is in fluid communication with the valve 120 via a conduit 112. The vessel 102 is fitted with an agitator, e.g., a stirrer 106 as shown that rotates about a vertical shaft 104. The stirrer 106 is powered by an overhead motor (not shown) and is used to subject the particles in the slurry to rotary motion. Other agitators effective to maintain the particles suspended in the liquid can be used, for example, shakers, bubblers, and the like.

The entire outlet port 110 may be a portion of the vessel (i.e., it may have the same material of construction as the rest of the vessel) or alternatively, it may be manufactured from a separate conduit that comprises a metal, a ceramic or a polymer. An exemplary outlet port 110 comprises a fluoroelastomer such as VITON® commercially available from DuPont. The outlet port 110 has a valve 120. The valve 120 may be a gate valve, a ball valve, a sluice valve, or any other type of valve that may restrict or stop the flow of fluid through the outlet port 110. The valve 120 may be operated manually or in conjunction with a solenoid that is controlled by a computer. The valve 120 may be closed completely, opened completely or set to an intermediate (variable) open position depending upon the velocity of liquid flow desired in the conduit 112. In an exemplary embodiment, the valve 120 is a ball valve.

The pump 114 may be located at a distance of 0.5 to 3 meters from the bottom of the vessel 102. In an exemplary embodiment, the pump 114 is located at a distance of 0.60 meters (about 2 feet) to 1 meter (about 3.3 feet) from the bottom of the vessel 102. The pump 114 may be a rotary or reciprocating positive displacement pump. Example of pumps are peristaltic pumps, centrifugal pumps, gear pumps, screw pumps, progressing cavity pumps, roots-type pumps, plunger pumps, triplex-style plunger pumps, compressed-air-powered double-diaphragm pumps, rope pumps, flexible impeller pumps, or the like. An exemplary pump is a peristaltic pump.

The pump 114 or the compressor 116 both operate to discharge the slurry from the vessel 102. The pump 114 may be used in lieu of the compressor 116 or vice versa. Both the pump 114 and the compressor 116 may be simultaneously used to discharge the slurry from the vessel 102 if desired.

The conduit 112 is reversibly attachable to an outlet port of the pump 114 and lies downstream of the pump 114. The conduit has a length that is inversely proportional to the difference in density between the first material and the second material in the composition, i.e., the smaller the difference in density, the longer the length of the conduit. The conduit 114 may have a length of 3 meters to 100 meters. An exemplary length for the conduit 114 is about 4 meters to 6 meters. The portion of the conduit 114 that lies downstream of the pump 114 generally has a steady incline of an angle $\alpha$ (also termed the angle of inclination $\alpha$) that varies from 3 degrees to 45 degrees, specifically 4 to 15 degrees, and more specifically 5 to 10 degrees with respect to a horizontal as depicted in the FIG. 1. The conduit 114 incline begins at the pump outlet and continues till the conduit contacts the ground or a platform (not shown). The conduit 114 is preferably inclined along a straight line that has the angle of inclination α when measured with respect to a horizontal.

In another embodiment, the angle of inclination α of the conduit is zero degrees at the point of contact with the pump 114. In other words, the conduit is kept level from its beginning (the point of contact with the pump 114) to its end. The conduit has disposed at its end a container (not shown) to which it discharged the separated contents of the vessel 103.

The conduit 112 may be manufactured from a metal, a ceramic, or a polymer and may be rigid or flexible. An exemplary conduit 112 is manufactured from a fluoroelastomer such as VITON® commercially available from DuPont.

The inlet port 108 receives the liquid and the fractionated particles. The fractionated particles contain at least two materials, a first material (the more dense material) and a second material (the less dense material) that are to be separated. The inlet port 108 is fitted with a valve 118 and an optional compressor 116. The valve 118 is similar to the valve 120 and may comprise one of the valves specified for valve 120. The compressor 116 functions to supply compressed air to the vessel 102 and to compress the contents of the vessel 102 to provide a surge in pressure during the discharging the contents of the vessel 102. The effect of the surging is detailed below.

In an embodiment, in a method of using the device 100, a group of the optionally ground, fractionated particles (of the composition) having a first polydispersity index is introduced to the vessel 102 through the inlet port 108. The group of fractionated particles comprises at least two materials (a first material and a second material) one of which, the first material is denser than the second material. It is desirable to separate the first material from the second material using the device 100. A liquid is introduced into the vessel 102 and the mixture of the liquid and the particles are stirred using the stirrer 106 to form a slurry 202. The valve 118 is opened to permit entry of the particles and the liquid into the vessel 102. During the admission of the particles and the liquid into the vessel 102, the valve 120 is closed. The optional compressor 116 is turned off during the admission of the particles and the liquid into the vessel 102.

The slurry comprises the particles for the composition and the liquid. The amount of particles is about 20 to 80, preferably 30 to 60 weight percent based on the total weight of the particles and the liquid (i.e., the slurry) in the vessel. The amount of liquid is about 20 to 80, preferably 40 to 70 weight percent based on the total weight of the particles and the liquid (i.e., the slurry) in the vessel. The liquid may be any fluid that is in liquid form at the temperature at which the stirring is conducted. The liquid may comprise organic solvents, liquid carbon dioxide or water. It is desirable for the liquid not to dissolve the particles or to degrade them.

In an embodiment, the liquid may comprise two or more incompatible liquids having different densities. The differing densities may be used to segregate the different materials from one another in order to effect separation. In an exemplary embodiment, the liquid is water.

The slurry (which is a mixture of a first material and a second material dispersed in the liquid) is stirred with the valve 110 is closed. The slurry 202 is stirred at a rotational velocity so as to prevent the settling of the particles. When the composition comprises iridium and zirconium oxide, the slurry 202 is stirred at a rotational velocity that prevents the zirconium oxide from settling down in the vessel. While the slurry 202 is being stirred, the valve 120 is opened and the pump 114 or the compressor 116 is turned on. Both the pump 114 and the compressor 116 may also be simultaneously turned on if desired.

If only the pump 114 is turned on, it is first turned on at a slow rotational speed to start pumping material through the conduit 112. The particles in the slurry continue to rotate as they are transported through the conduit 112. As more of the slurry is discharged from the vessel 102 to the conduit 112, the pump is set to operate at higher speeds such that the heavier first material settles in the conduit and the lighter second material is moved through the conduit and discharged to the container. The higher rotational speed of the pump 114 is at least 100% greater than the lower rotational speed of the pump.

The use of a peristaltic pump 114 produces periodic surges in flow because of the nature of operation of peristaltic pumps. The periodic surges in flow produce greater fluid velocities in the conduit, which facilitate the separation between the first material and the second material as the slurry flows through the conduit 112. These periodic surges may also be produced by using the other pumps detailed above in lieu of the peristaltic pump. When, for example, a centrifugal pump is used, the valve 120 may be periodically opened and then closed during the discharge from the vessel to produce periodic surges (increases in fluid velocity) that facilitate separation of the first denser material from the second lighter material of the composition. The opening of the valve from its closed position produces a periodic surge in the slurry flow, which facilitates the separation of the first material from the second material. The surge results in an increase in liquid velocity of at least 10%, specifically at least 20% and more specifically at least 50%, over liquid velocity as compared with the liquid velocity in the absence of the surges.

If only the compressor 116 is used, it may also be used in conjunction with the valve 120 to produce periodic surges. The compressor 116 is used to increase the pressure in the vessel 102 to pressurize the slurry while it is being stirred. The valve 120 may be periodically opened and closed periodically to discharge the slurry from the vessel 102 with the concurrent initiation of surges in fluid flow to facilitate a separation of the materials from each other. It is to be noted that both the pump 114 and the compressor 116 may be simultaneously used. However, if the pump 114 is present in the device 100, there is no need for a compressor 116 and if a compressor 116 is present in the device 100, the pump 114 may be avoided since either of them may be used to produce surges in fluid flow.

As the slurry is transported through the conduit 112 the increase in fluid velocity during the surge results in the heavier material being disposed on the walls of the conduit 112 while the lighter material flows through the conduit and is collected in a first container. Additional liquid may be added to the vessel 102 under stirring to facilitate the discharging of any of the residual composition contained in the vessel 102 to the conduit 112.

In an embodiment, when all of the composition is discharged from the vessel 102, additional liquid is charged to the vessel and the pump speed increased to discharge the material disposed on the walls of the conduit 112 to a second container. In another embodiment, when all of the composition is discharged from the vessel 102, the conduit 112 is disconnected from the vessel 102 and the material disposed on the walls of the conduit is discharged to a second container.

The entire process detailed may be repeated with other groups of particles having a different average size to separate them from one another. The method disclosed above results in the separation of the different materials of the composition from one another. The method is inexpensive and efficient.

The method and the device disclosed herein are exemplified by the following non-limiting example.

Example

This example was conducted to demonstrate the method of separating two materials—a first heavier material (iridium) from a second lighter material (zirconium dioxide). As detailed above, during the growth of lutetium oxyorthosilicate, iridium (which is used as a crucible during the preparation of the lutetium oxyorthosilicate) is deposited on zirconium dioxide, which is used as insulation in the manufacturing device. Since iridium is expensive, it is desirable to separate it from the zirconium dioxide and to recover it. Iridium however bonds strongly to the zirconium oxide and the two cannot be easily separated (debonded) by just scraping the iridium from the zirconium oxide. In order to debond the iridium from the zirconium oxide, the mixture of these materials is subjected to grinding.

The grinding is conducted in a ring grinder till the particle size reaches between 100 and 250 micrometers. The grinding causes the particles of zirconium dioxide to be debonded from the particles of iridium. The particles of the composition are then subjected to sieving to achieve groups of particles of different sizes each having a polydispersity index of less than 1.2.

Each group of particles of the composition is then charged to a vessel fitted with a stirrer. Water is then charged to the vessel and the stirrer is used to stir the mixture to form a slurry.

The outlet port of the vessel is fitted with a valve, a peristaltic pump and a conduit as shown in the FIG. 1. The valve at the outlet port is then opened to discharge the slurry into the conduit. The discharge of the slurry from the vessel at a high speed (during the surges of the peristaltic pump) results in a black iridium powder settling on the walls of the conduit, while the yellow zirconium oxide is passed through the conduit to the container (not shown). In short, the increase in rotary motion during the surges forces the denser particle outwards to contact the walls of the conduit and facilitate their adhesion to the walls of the conduit.

As the slurry is pumped from the vessel through the conduit, more water is added to the vessel, to keep the ground fractionated material suspended in the liquid in the vessel. When only black iridium remains, the speed on the pump is increased to discharge all of the iridium to the conduit following which the conduit moved to a container. The iridium is then flushed into the container from the conduit. After the iridium is collected it may be sent to be melted into an ingot.

The process may be repeated with other groups of particles having different average sizes collected after the fractionation.

While this disclosure describes exemplary embodiments, it will be understood by those skilled in the art that various changes may be made and equivalents may be substituted for elements thereof without departing from the scope of the disclosed embodiments. In addition, many modifications may be made to adapt a particular situation or material to the teachings of this disclosure without departing from the essential scope thereof. Therefore, it is intended that this disclosure not be limited to the particular embodiment disclosed as the best mode contemplated for carrying out this disclosure.

What is claimed is:

1. A device comprising:

a vessel having an inlet port and an outlet port; where the vessel is provided with an agitator that is operative to agitate a content of the vessel;

at least one of a compressor and a pump that is in fluid communication with the vessel through a valve;

where the compressor is in fluid communication with the inlet port; where the compressor lies upstream of the vessel;

where the pump is in fluid communication with the outlet port; where either the pump, the compressor and the valve, or the pump and the valve are operative to produce a surge in a flow of a slurry discharged from the vessel; and a conduit in fluid communication with the outlet port; where the conduit contacts the pump outlet and has a steady incline of 3 degrees to 45 degrees from the pump outlet with respect to a horizontal; where the surge in the flow of the slurry is effective to separate particles of different densities during their flow inside the conduit; where a first material is disposed on an inner surface of the conduit and where a second material flows through and exits the conduit; and wherein the first material has a higher density than the second material.

2. The device of claim 1, where the agitator is a stirrer that is operative to subject the content of the vessel to rotary motion.

3. The device of claim 1, where the pump is a peristaltic pump, a centrifugal pump, a gear pump, a screw pump, a progressing cavity pump, a Roots-type pump, a plunger pump, a triplex-style plunger pump, a compressed-air-powered double-diaphragm pump, a rope pump, or a flexible impeller pump.

4. The device of claim 1, where the pump is a peristaltic pump.

5. The device of claim 1, where the valve is a ball valve, a gate valve or a sluice valve.

* * * * *